US008335448B2

(12) United States Patent
Nakajima

(10) Patent No.: US 8,335,448 B2
(45) Date of Patent: Dec. 18, 2012

(54) CONVEYANCE UNIT AND IMAGE FORMING APPARATUS COMPRISING THE SAME

(75) Inventor: Takao Nakajima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 396 days.

(21) Appl. No.: 12/695,337

(22) Filed: Jan. 28, 2010

(65) Prior Publication Data

US 2010/0196036 A1 Aug. 5, 2010

(30) Foreign Application Priority Data

Jan. 30, 2009 (JP) ..... 2009-020239

(51) Int. Cl.
*G03G 15/20* (2006.01)

(52) U.S. Cl. ..... 399/68

(58) Field of Classification Search ..... 399/68, 399/92, 303, 305, 312, 316
See application file for complete search history.

(56) References Cited

U.S. PATENT DOCUMENTS 5,121,170 A * 6/1992 Bannai et al. ..... 399/303
5,166,735 A * 11/1992 Malachowski ..... 399/68

FOREIGN PATENT DOCUMENTS

JP 3-128851 A 5/1991
JP 11-65188 A 3/1999
JP 2007-78997 A 3/2007

OTHER PUBLICATIONS

Machine translation of reference Ochiai et al (JP 11-065,188 A), Listed in IDS. Pub date Mar. 5, 1999.*

* cited by examiner

*Primary Examiner* — Walter L Lindsay, Jr.
*Assistant Examiner* — Rodney Bonnette
(74) *Attorney, Agent, or Firm* — Canon USA, Inc., IP Division

(57) ABSTRACT

An image forming apparatus includes a transfer unit configured to transfer a toner image to a sheet, a fixing unit configured to fix the toner image transferred to the sheet on the sheet, a conveyance unit disposed between the transfer unit and the fixing unit to convey the sheet, a moving unit configured to move the conveyance unit, and a control unit configured to controls the moving unit to move the conveyance unit so that a speed of a leading edge of the sheet conveyed from the transfer unit to the fixing unit is reduced, when the leading edge of the sheet reaches the fixing unit.

17 Claims, 15 Drawing Sheets

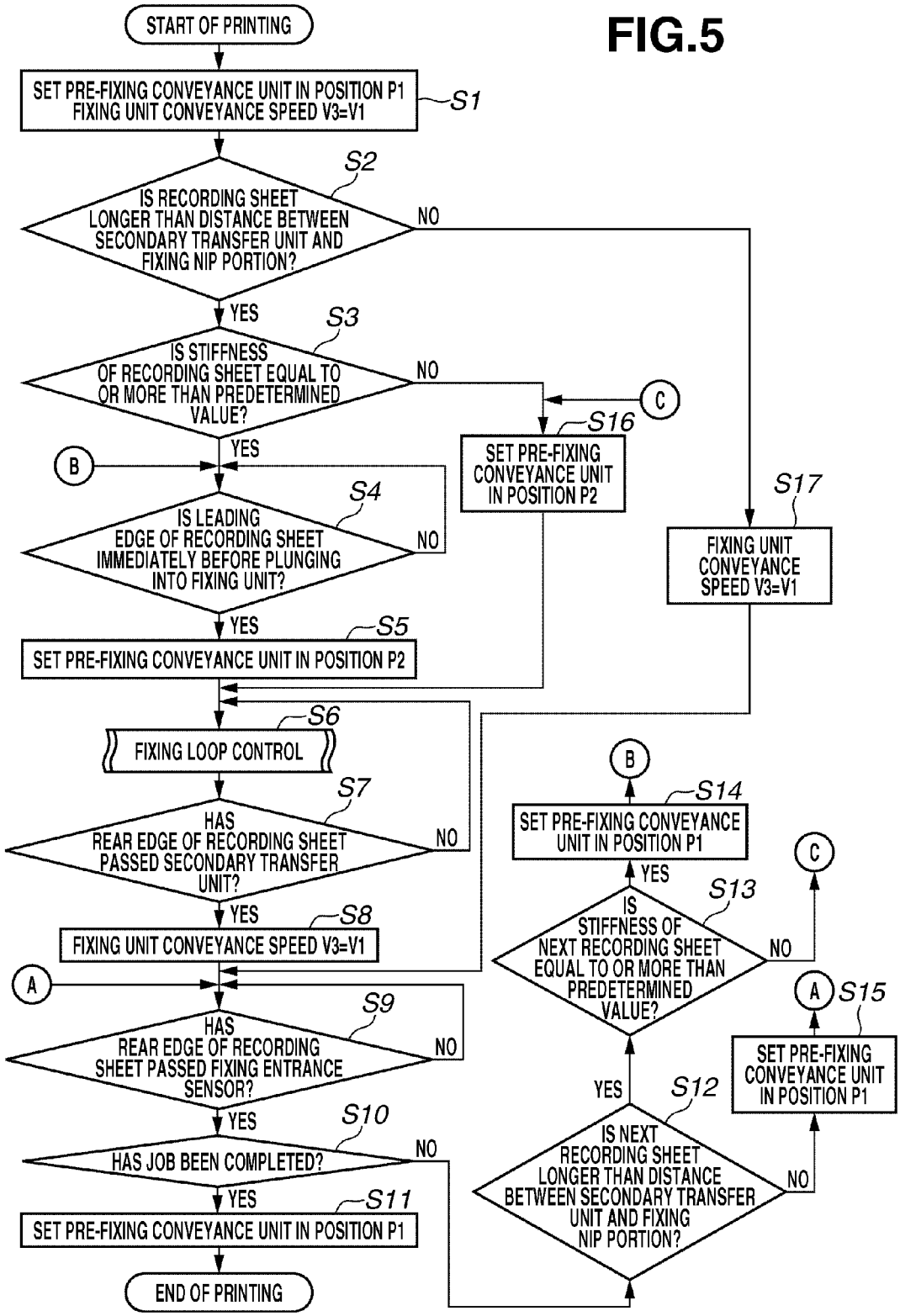
FIG.5
START OF PRINTING
SET PRE-FIXING CONVEYANCE UNIT IN POSITION P1
FIXING UNIT CONVEYANCE SPEED V3=V1
S1
S2
IS RECORDING SHEET LONGER THAN DISTANCE BETWEEN SECONDARY TRANSFER UNIT AND FIXING NIP PORTION?
NO
YES
S3
IS STIFFNESS OF RECORDING SHEET EQUAL TO OR MORE THAN PREDETERMINED VALUE?
NO
C
S16
SET PRE-FIXING CONVEYANCE UNIT IN POSITION P2
YES
B
S4
IS LEADING EDGE OF RECORDING SHEET IMMEDIATELY BEFORE PLUNGING INTO FIXING UNIT?
NO
S17
FIXING UNIT CONVEYANCE SPEED V3=V1
YES
S5
SET PRE-FIXING CONVEYANCE UNIT IN POSITION P2
S6
FIXING LOOP CONTROL
S7
HAS REAR EDGE OF RECORDING SHEET PASSED SECONDARY TRANSFER UNIT?
NO
YES
S8
FIXING UNIT CONVEYANCE SPEED V3=V1
A
S9
HAS REAR EDGE OF RECORDING SHEET PASSED FIXING ENTRANCE SENSOR?
NO
YES
S10
HAS JOB BEEN COMPLETED?
NO
YES
S11
SET PRE-FIXING CONVEYANCE UNIT IN POSITION P1
END OF PRINTING
B
S14
SET PRE-FIXING CONVEYANCE UNIT IN POSITION P1
YES
C
S13
IS STIFFNESS OF NEXT RECORDING SHEET EQUAL TO OR MORE THAN PREDETERMINED VALUE?
NO
A
S15
SET PRE-FIXING CONVEYANCE UNIT IN POSITION P1
YES
S12
IS NEXT RECORDING SHEET LONGER THAN DISTANCE BETWEEN SECONDARY TRANSFER UNIT AND FIXING NIP PORTION?
NO

CONVEYANCE UNIT AND IMAGE FORMING APPARATUS COMPRISING THE SAME

BACKGROUND OF THE INVENTION

1. Field of the Invention

The present invention relates to an image forming apparatus that forms an image on a sheet.

2. Description of the Related Art

A transfer unit transfers an image to a sheet, and a fixing unit fixes the image on the sheet. The image transferred by the transfer unit remains unfixed until the image is fixed by the fixing unit. Hence, contact to an image surface side of the sheet needs to be avoided while the sheet is conveyed between the transfer unit and the fixing unit.

Thus, in order to convey the sheet without touching the image surface side of the sheet, a suction conveyance unit that suctions and conveys the sheet is provided between the transfer unit and the fixing unit (e.g., refer to Japanese Patent Laid-Open Nos. 2007-78997, 3-128851, and 11-65188).

There has recently been a rise in demand for a technology that enables formation of images on various types of sheets. In the case of conveying a sheet of high stiffness (large grammage), there may be following problems.

Depending on an inclination in the suction conveyance unit, the sheet plunges, not in accordance with the suction conveyance unit, into the fixing unit while maintaining an almost linear shape. When a leading edge of the sheet plunges into the fixing device, a part of the sheet is still in the transfer unit. Thus, the shock generated when the sheet plunges into the fixing unit is transmitted to the transfer unit via the sheet, causing a defective image.

SUMMARY OF THE INVENTION

The present invention is directed to an image forming apparatus that can prevent a defective image from being produced even when an image is formed on a sheet with high stiffness.

According to an aspect of the present invention, an image forming apparatus includes a transfer unit configured to transfer a toner image to a sheet, a fixing unit configured to fix the toner image transferred to the sheet on the sheet, a conveyance unit disposed between the transfer unit and the fixing unit to convey the sheet, a moving unit configured to move the conveyance unit, and a control unit configured to controls the moving unit to move the conveyance unit so that a speed of a leading edge of the sheet conveyed from the transfer unit to the fixing unit is reduced, when the leading edge of the sheet reaches the fixing unit.

Lowering the speed of the leading edge of the sheet when the leading edge of the sheet reaches the fixing unit enables reduction in a plunging shock of the leading edge of the sheet into the fixing unit. Thus, a shock transmitted to the transfer unit via the sheet is reduced. As a result, image disturbance or the like in the transfer unit can be reduced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 5 is a flowchart illustrating the active swinging control of the pre-fixing conveyance unit.

DESCRIPTION OF THE EMBODIMENTS

Various exemplary embodiments, features, and aspects of the invention will be described in detail below with reference to the drawings.

Figure 1:
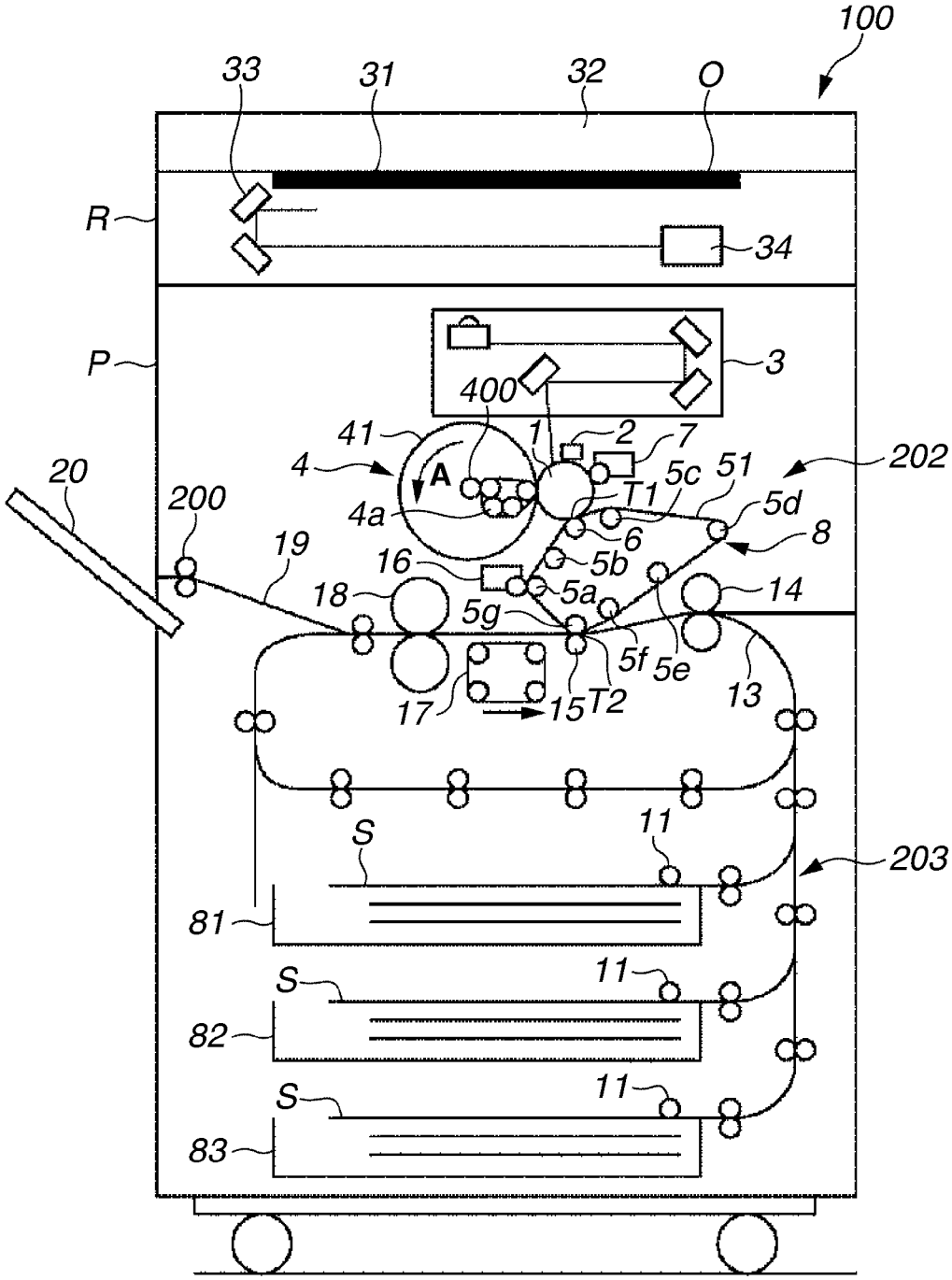
FIG. 1 is a front vertical sectional view schematically illustrating a configuration of an image forming apparatus according to an exemplary embodiment of the present invention.

FIG. 1 illustrates a schematic configuration of a color copying machine that is an example of an image forming apparatus according to a first exemplary embodiment of the present invention.

Referring to FIG. 1, the color copying machine 100 includes a color copying machine body (hereinafter, referred to as an apparatus body) P. The apparatus body P includes an image forming unit 202 and a paper feeding unit 203 configured to feed a sheet S. The apparatus body 201 includes a reader unit R in its upper part.

The reader unit R includes a document glass plate 31 and a document pressing plate 32 that can be opened/closed relative to the document glass plate 31. A color document O is placed with its image surface set downward on the document glass plate 31 according to a predetermined laying reference position, and the document pressing plate 32 is placed over the color document O to set the document O.

The document pressing plate 32 can be replaced by an automatic document feeder (ADF) configured to automatically feed a sheet-like document onto the document glass plate 31. The reader unit R includes a moving optical system driven to move along a bottom surface of the document glass plate 31. This moving optical system 33 optically scans the downward image surface of the document O on the document glass plate 31.

The document scanning light is imaged by a charge coupled device (CCD) 34, i.e., a photoelectric conversion element (solid-state image sensor), and the image is separated into three primary colors of red, green, and blue (R, G, and B) to be read. Read signals of R, G and B are entered to an image processing unit (not illustrated).

The image forming unit 202 includes an electrophotographic photosensitive drum 1 (hereinafter, referred to as a photosensitive drum), which is an image bearing member to be rotated anticlockwise by a motor (not illustrated).

The image forming unit 202 includes a charger 2 and a laser scanner 3. The image forming unit 202 includes a cleaning device 7 configured to remove toner remaining on the photosensitive drum, and a developing unit 4.

The photosensitive drum 1 is driven to rotate anticlockwise at a predetermined speed. The charger 2 serving as a charging unit uniformly charges a surface of the photosensitive drum 1 to a predetermined polarity and potential.

The laser scanner 3 includes a laser output unit, a polygon mirror, an imaging lens, and a folding mirror. The laser scanner 3 outputs a laser beam (optical signal) modulated according to an image information signal entered from the image processing unit (not illustrated). The laser beam scans to exposes a charged surface of the rotated photosensitive drum 1 thereto.

The scanning and exposing performed by the laser scanner 3 results in formation of an electrostatic latent image on a surface of the photosensitive drum 1. In addition to the image information signal based on the image information read by the reader unit R, an image information signal synthesized and generated based on image information transmitted from an external device such as a personal computer may be used.

The developing unit 4 includes a rotary 41 rotated around a rotation center 400 in an anticlockwise direction indicated by an arrow A, and four color developing devices fixed to the rotary 41 for full-color development, i.e., a black developing device 4*a*, and developing devices of yellow, magenta, and cyan (not illustrated).

The developing unit 4 is configured so that the rotary 41 rotates by a predetermined angle in the arrow direction at a predetermined control timing to move each developing device in a developing position facing the photosensitive drum 1. In this developing position, a distance (SD distance) between the photosensitive drum 1 and a developing sleeve of a developing device side is held within a predetermined range, and each developing device develops an electrostatic image for each color, thereby toner images are sequentially formed on the photosensitive drum.

The image forming unit 202 includes an intermediate transfer belt unit 8. The intermediate transfer belt unit 8 includes an endless intermediate transfer belt 51 configured to superpose four-color toner images to form a transfer image, and then transfer the multi-color image to the sheet S. The intermediate transfer belt unit 8 includes a primary transfer roller 6 configured to transfer a toner image of each color developed on the photosensitive drum 1 to the intermediate transfer belt 51.

The intermediate transfer belt 51 is an endless belt made of a flexible dielectric material, and suspended around a plurality of rollers 5*a* to 5*g*. This intermediate transfer belt 51 is driven, for example, by using the roller 5*a* as a drive roller, to rotate clockwise at a speed almost equal to a rotational speed of the photosensitive drum 1.

An outer surface of the intermediate transfer belt 51 is in contact with the photosensitive drum 1 between the rollers 5*b* and 5*c*. This contact portion is a primary transfer nip portion T1. In the primary transfer nip portion T1, the primary transfer roller 6 is disposed on an opposite side of the photosensitive drum 1 with respect to the intermediate transfer belt 51 in contact with an inner surface of the intermediate transfer belt 51.

A primary transfer voltage with a polarity reverse to that of toner is applied to the primary transfer roller 6 at predetermined control timing. The application of the primary transfer voltage enables transferring of a toner image of each color developed on the photosensitive drum 1 to the intermediate transfer belt 51.

Toner remaining on the intermediate transfer belt 51 is scraped off by a belt cleaning unit 16 disposed in such a manner as sandwiching the intermediate transfer belt 51 and configured to clean the intermediate transfer belt 51.

A secondary transfer outer roller 15 is provided to transfer a toner image from the intermediate transfer belt 51 to the sheet S. The secondary transfer outer roller 15 can be contacted with and separated from the intermediate transfer belt 51 by a pressure control mechanism (not illustrated).

When transferring the toner image to the sheet S, the secondary transfer outer roller 15 moves to a position where the secondary transfer outer roller 15 contacts and presses the roller 5*g* of the rollers 5*a* to 5*g* on which the intermediate transfer belt 51 is suspended while sandwiching the intermediate transfer belt 51 therebetween. The movement to the first position enables formation of a secondary transfer nip portion T2 as a transfer unit between the secondary transfer outer roller 15 and an outer surface of the intermediate transfer belt 51.

During a standby period when no toner image is transferred to the sheet S, the secondary transfer outer roller 15 moves to a second position away from the outer surface of the intermediate transfer belt 51. On a downstream side of the secondary transfer nip portion T2, a fixing device 18 is provided to fix an unfixed image on the sheet. A pre-fixing conveyance unit 17 is provided between the secondary transfer nip portion T2 serving as a transfer unit and the fixing device 18. A configuration of the pre-fixing conveyance unit 17 will be described in detail below.

The paper feeding unit 203 includes sheet cassettes 81 to 83 configured to store sheets S and be detachable from the apparatus body 201. The sheets S stored in the sheet cassettes 81 to 83 are fed by pickup rollers 11.

The apparatus body P includes a registration roller 14 and the pre-fixing conveyance unit 17 configured to convey a sheet to which a toner image has been transferred to the fixing device 18 as described below. The registration roller 14 is provided on an upstream side of the secondary transfer nip portion T2 for the purpose of improving orientation positional accuracy of the sheet S and feeding the sheet S in good timing with the toner image on the intermediate transfer belt 51.

Next, an image forming operation of the color copying machine 100 thus configured will be described.

When the document O is placed with its image surface set downward on the document glass plate 31, and then pressed to the document glass plate 31 by the document pressing plate 32 from above, the moving optical system 33 moves while illuminating the document to scan the image surface of the document. The document scanning light is imaged by the CCD 34, and separated into three primary colors of R, G, and B to be read.

Then, each of the read signals of R, G, and B is entered to the image processing unit (not illustrated). The image processing unit performs various image processing operations for this signal to output it as an image information signal to the laser scanner 3. The laser scanner 3 modulates the image information signal into an optical signal, and applies the modulated optical signal as an optical signal of a first color to the photosensitive drum through the lens and the reflection mirror.

In this case, the photosensitive drum 1 has been uniformly charged to a predetermined polarity and potential by the charger 2. The application of the optical signal results in formation of an electrostatic latent image.

A developing device selected among the plurality of developing devices disposed in the developing unit 4 corresponding to the first color develops the electrostatic latent image to form a toner image of the first color. The primary transfer roller 6 transfers the toner image formed on the photosensitive drum to the intermediate transfer belt 51 at the primary transfer nip portion T1.

In the case of a color mode, the intermediate transfer belt 51 to which the toner image has been transferred is further rotated to enable formation and transfer of a next toner image. During this period, the developing unit 4 rotates by 90° in an arrow direction B so as to move a next designated color developing device to oppose to the photosensitive drum 1, and prepares for development of a next electrostatic image.

After completion of the primary transfer of the first color, as in the case of the first color, latent image formation, development, and primary transfer are repeated for a second color, a third color and a fourth color to sequentially stack toner images of the respective colors on the intermediate transfer belt 51.

Simultaneously with such image forming operations, one of the sheets S stored in the sheet cassettes 81 to 83 is separated to be fed by a predetermined control timing, and conveyed through a sheet feeling path 13 to the registration roller 14.

At this time, the registration roller 14 is in a stopped state. The sheet S abuts on the stopped registration roller 14 to correct the skewing of the sheet S. Then, the sheet S is conveyed at a predetermined timing to the secondary transfer nip portion T2, which is constituted by the intermediate transfer belt 51 and the secondary transfer outer roller 15. The secondary transfer outer roller 15 has been moved to the first position at a predetermined timing.

The sheet S is sandwiched and conveyed at the secondary transfer nip portion T2. During this period, a predetermined secondary transfer voltage is applied to the secondary transfer outer roller 15 to electrostatically transfer toner images of a plurality of colors on the intermediate transfer belt 51 at a time to the sheet S. Unfixed toner images are formed (transferred) on the sheet S.

The sheet S thus conveyed to the secondary transfer nip portion T2 and having the toner images transferred thereto by the secondary transfer outer roller 15 is separated from a surface of the intermediate transfer belt 51 to be conveyed to the fixing device 18 by the pre-fixing conveyance unit 17. The fixing device 18 applies heat and pressure to the sheet S, and thereby the unfixed toner images are fused and fixed on the sheet S, becoming a fixed image.

The sheet S having the toner images fixed thereon is conveyed through a sheet path 19 to a discharge roller pair 2000 and discharged onto a discharge tray 20.

Figure 2:
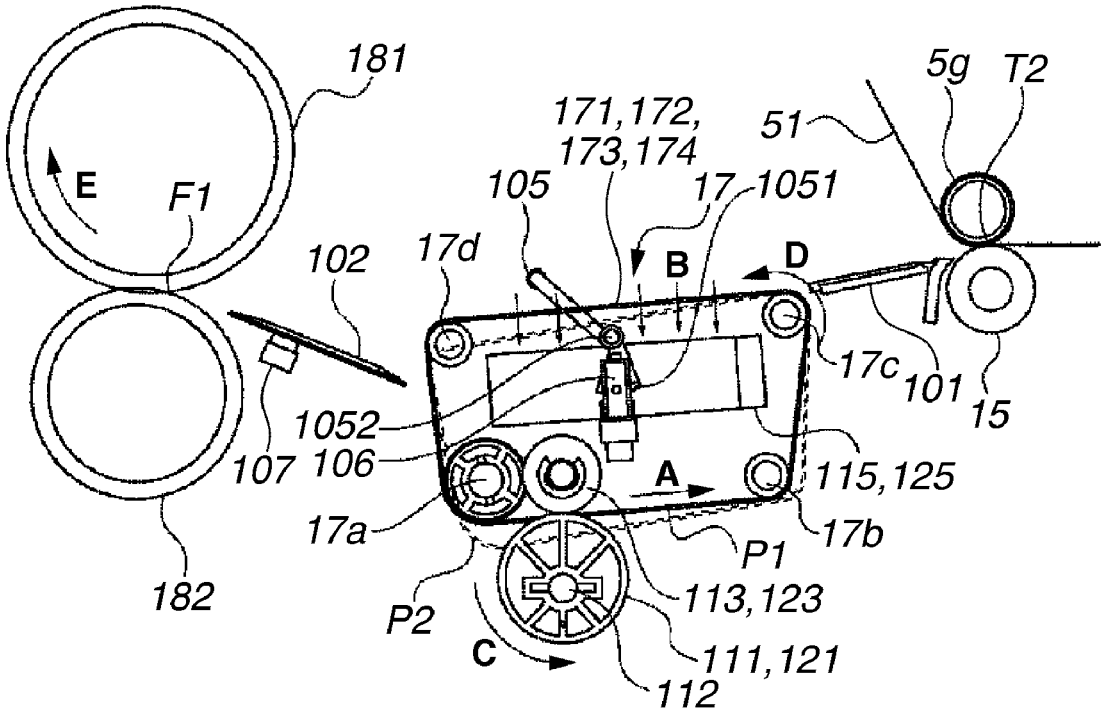
FIG. 2 is a front view illustrating a configuration of a pre-fixing conveyance unit according to a first exemplary embodiment.
Figure 3:
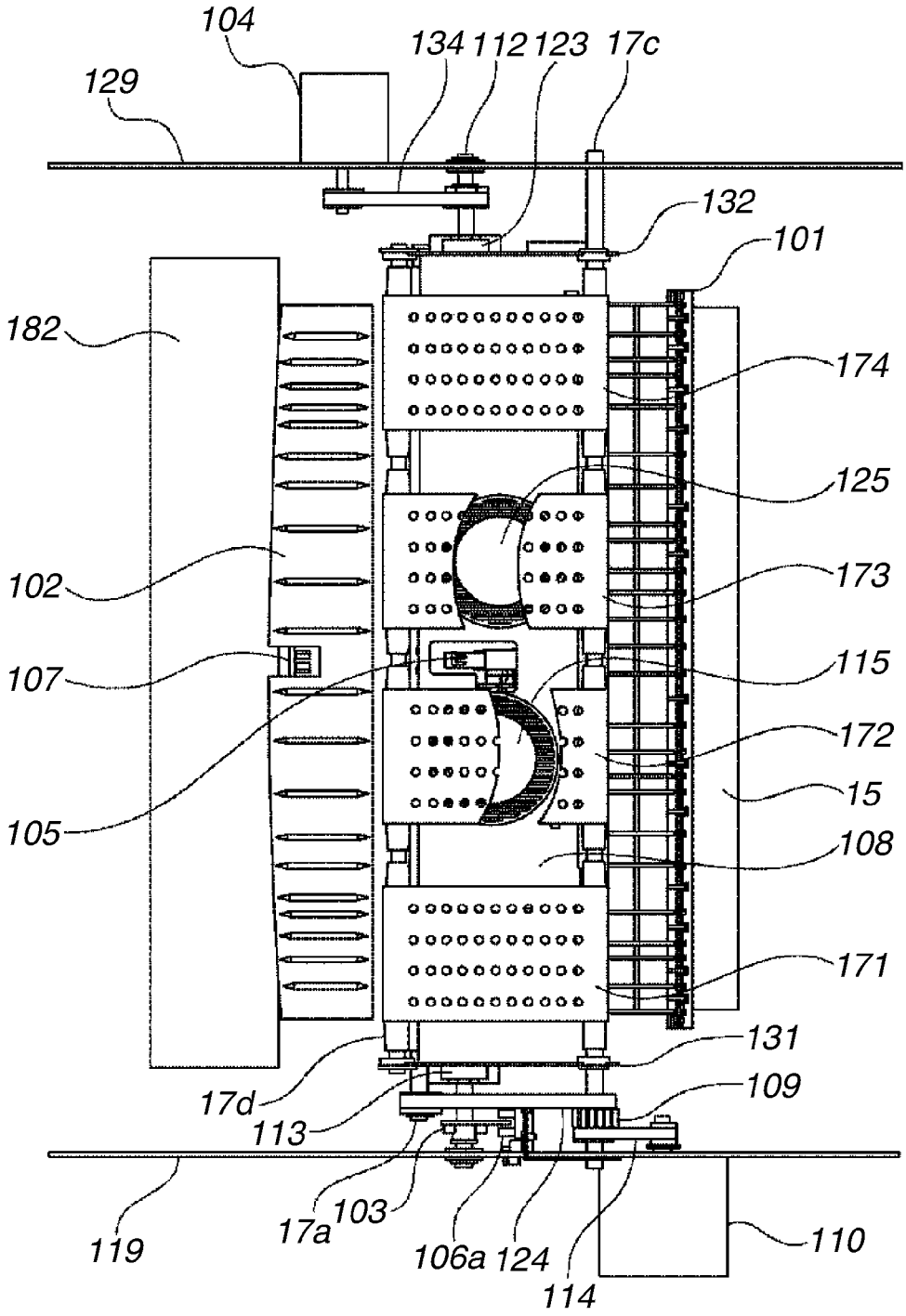
FIG. 3 is a top view illustrating the configuration of the pre-fixing conveyance unit of the first exemplary embodiment.

Next, the pre-fixing conveyance unit 17 and its related components according to the exemplary embodiment will be described in detail. FIG. 2 is a front view illustrating a configuration of the pre-fixing conveyance unit 17. FIG. 3 is a front view.

As illustrated in FIGS. 2 and 3, in the pre-fixing conveyance unit 17, a front plate 131 and a rear plate 132 support a roller constituted of four rollers, i.e., a drive roller 17*a*, driven rollers 17*b* and 17*d*, and a swinging roller 17*c*, to rotate freely. Endless conveyance belts 171, 172, 173, and 174 having numerous holes are suspended by the four rollers.

A conveyance frame 108 disposed inside the conveyance belts supports the front plate 131 and the rear plate 132. Suction fans 115 and 125 provided in the conveyance frame 108 suction the sheet S to be fed in the arrow direction B in FIG. 2 via the numerous holes of the conveyance belts 171, 172, 173, and 174.

In other words, upper surfaces of the conveyance belts 171, 172, 173, and 174 form a conveyance surface of the pre-fixing conveyance unit 17. The sheet is suctioned to the conveyance surface by the suction fans 115 and 125, and conveyed by rotation of the conveyance belts 171, 172, 173, and 174.

The conveyance frame 108 includes a loop detection flag 105 and a loop detection sensor 106 to be used during loop control described below. The loop detection flag 105 is rotatable around a loop detection flag rotary shaft 1052.

The loop detection sensor 106 outputs a signal according to a position of the loop detection flag 105 by being pressed and rotated by a loop portion of the sheet. Hence, the loop detection sensor 106 outputs a signal according to a loop amount of the sheet.

Both ends of the swinging roller 17*c* are supported by a body front plate 119 and a body rear plate 129 of the image forming apparatus body to freely rotate. The swinging roller 17*c* can rotate the pre-fixing conveyance unit 17 together with swinging members 113 and 123 described below with respect to the body.

The body front plate 119 of the image forming apparatus body includes a drive motor 110. The conveyance belts 171, 172, 173, and 174 are rotated by a driving force sequentially transmitted from the drive motor 110 to a drive transmission belt 114, an idle pulley 109, a drive transmission belt 124, and the drive roller 17*a*.

The conveyance belts 171, 172, 173, and 174 are rotated in an arrow direction A in FIG. 1 by rotating the drive roller 17*a* to suction and convey the sheet S at a conveying speed V2. The idle pulley 109 is disposed in the swinging roller 17*c* to freely rotate with respect to the swinging roller 17*c*.

A swinging motor 104 is provided at the body rear plate 129 of the image forming apparatus body. The swinging motor 104 rotates, via a drive transmission belt 134, a swinging shaft 112 having both ends rotatably supported by the body front plate 119 and the body rear plate 129.

The swinging shaft 112 includes swinging cams 111 and 121 similar in shape and a swinging flag 103. A cam phase detection sensor 106*a* disposed in the body front plate 119 detects a phase of the swinging flag 103 to enable detection of phases of the swinging cams 111 and 121.

The swinging cams 111 and 121 are in contact with the swinging members 113 and 123 disposed on the front plate 131 and the rear plate 132 of the pre-fixing conveyance unit 17. Rotating the swinging cams 111 and 121 in an arrow direction C of FIG. 2 enables swinging of the pre-fixing conveyance unit 17 around the swinging shaft 17*c* in an arrow direction D of FIG. 2. In other words, the pre-fixing conveyance unit 17 is moved in a thickness direction of the conveyed sheet.

A state where the swinging members 113 and 123 are in contact with top dead centers of the swinging cams 111 and 121 is set as a first position P1 that is a home position of the pre-fixing conveyance unit 17. A state where the swinging members 113 and 123 are in contact with bottom dead centers of the swinging cams 111 and 121 is set as a second position P2 that is a release position of the pre-fixing conveyance unit 17 indicated by a dotted line of FIG. 2.

Between the first position P1 and the second position P2 of the pre-fixing conveyance unit 17, positions of the upper surfaces of the conveyance belts 171, 172, 173, and 174 that are conveyance surfaces of the pre-fixing conveyance unit 17 are different from one another, and a sheet conveyance angle (sheet conveyance direction) of the pre-fixing conveyance unit 17 varies.

When the pre-fixing conveyance unit 17 is in the first position P1, the pre-fixing conveyance unit 17 conveys the sheet in a first direction that is almost horizontal. When the pre-fixing conveyance unit 17 is in the second position P2, the pre-fixing conveyance unit 17 conveys the sheet in a second direction set downward more than the conveying direction when the pre-fixing conveyance unit 17 is in the first position P1. The swinging cams 111 and 121 and the swinging motor 104 constitute a moving unit that moves the conveyance surface of the pre-fixing conveyance unit 17 i.e., a suctioning and conveying unit.

As described above, on the feeding direction upstream side of the pre-fixing conveyance unit 17, the secondary transfer nip portion T2, which is formed by the secondary transfer outer roller 15, the intermediate transfer belt 51 and the secondary transfer roller inner roller 5*g*, is provided. The sheet S held and conveyed by the secondary transfer nip portion T2 is conveyed at a conveying speed V1. In order to stabilize a sheet conveyance behavior of the sheet S passed through the secondary transfer nip portion T1, a secondary transfer exit guide 101 is disposed on the body.

On the feeding direction downstream side of the pre-fixing conveyance unit 17, the fixing device 18 including a fixing roller 181 and a pressure roller 182 is provided. The fixing roller 181 and the pressure roller 182 constitute a fixing nip portion F1 that as a fixing unit.

The fixing roller 181 is driven by the fixing motor to rotate in an arrow direction E in FIG. 2. The sheet S held and conveyed by the fixing nip portion F1 is conveyed at a conveying speed V3. In order to stabilize a behavior of the sheet S that plunges into the fixing nip portion F1, a fixing entrance guide 102 is provided as a guiding member on the feeding direction downstream side of the pre-fixing conveyance unit 17.

In order to detect a leading edge of the sheet S during active swinging control of the pre-fixing conveyance unit 17 described below, a fixing entrance sensor 107 is provided as a sheet detection unit on a nonfeeding surface side of the fixing entrance guide 102.

Figure 4:
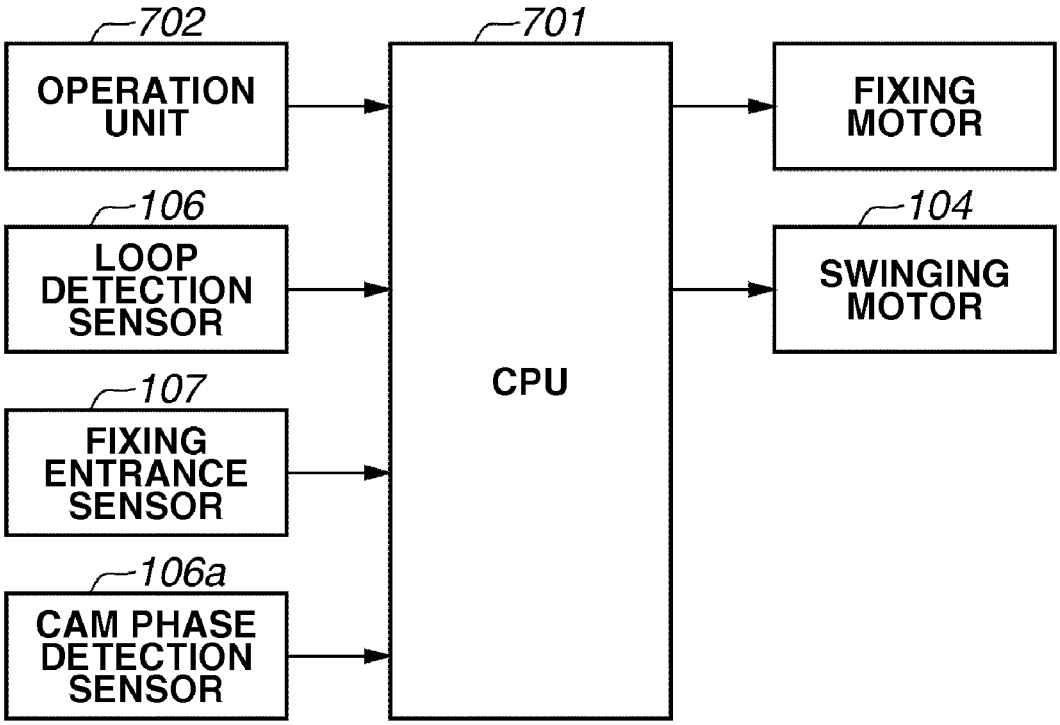
FIG. 4 is a control block diagram relating to an active swinging control of the pre-fixing conveyance unit and fixing loop control.

FIG. 4 is a block diagram illustrating a control system that controls an operation of the pre-fixing conveyance unit 17. A CPU 701 working as a control unit has an operation unit connected thereto to be operated by a user, and receives information on a type of a sheet (medium type) set in an operation unit 702.

Output signals from the loop detection sensor 106, the fixing entrance sensor 107, and the cam phase detection sensor 106*a* are entered to the CPU 701. The CPU 701 controls an operation of the fixing motor or the swinging motor 104 that drives the fixing roller 181.

Controlling the operation of the swinging motor 104 by the CPU 701 enables execution of the active swinging control of the pre-fixing conveyance units. The active swinging control of the pre-fixing conveyance unit is performed to move, immediately before the leading edge of the sheet S plunges into the fixing nip portion F1 during conveyance of the sheet S by the pre-fixing conveyance unit 17, a portion of the downstream side of the conveyance surface of the pre-fixing conveyance unit 17 downward.

Performing the active swinging control of the pre-fixing conveyance unit enables changing of a sheet profile (sheet shape) immediately before the sheet plunges into the fixing nip portion F1. Even when a shock generated at the plunging time of the leading edge of the sheet S into the fixing nip portion F1 are applied on the leading edge of the sheet S, the shock is absorbed by a slackened portion of the sheet formed by the change of the sheet profile.

Thus, propagation of shocks to the secondary transfer nip portion T2 via the sheet is reduced. An image forming apparatus can be provided in which no image disturbance or the like occurs and conveyance stability is secured.

The CPU 701 can perform fixing loop control by controlling the operation of the fixing motor based on a signal from the loop detection sensor 106 working as a loop detection unit. The fixing loop control is performed to control a rotational speed (conveying speed) of the fixing roller 181 so that a loop amount formed in the sheet S can be maintained in a predetermined amount between the secondary transfer nip portion T2 and the fixing nip portion F1 in the sheet S.

Performing the fixing loop control enables suppression of image disturbance or the like by preventing pulling or an excessive loop between the secondary transfer nip portion T2 and the fixing nip portion F1.

Referring to a flowchart of active swinging control of the pre-fixing conveyance unit of FIG. 5, a flowchart of fixing loop control of FIG. 6, FIG. 2, and FIGS. 7 to 11 illustrating operations, a sheet conveyance operation of the pre-fixing conveyance unit 17 will be described in detail below.

Information on a size, stiffness, or surface property concerning the sheet S to be fed is entered to the operation unit 702 of the image forming apparatus. The CPU 701 stores the information in a storage unit to stand-by for printing.

Upon entry of a printing start from a user, in step S1, the CPU 701 rotates the swinging motor 104, and rotates the swinging cams 111 and 121 until they come into contact with the top dead centers of the swinging members 113 and 123 and then stops the cams. As a result, the pre-fixing conveyance unit 17 is set in the first position P1 indicated by the solid line in FIG. 2.

The CPU 701 determines that a rotational angle in which the swinging cams 111 and 121 are in contact, at the top dead centers, with the swinging members 113 and 123 based on the cam phase detection sensor 106*a*. Simultaneously, the CPU 701 drives the fixing roller 181 to rotate in the arrow E direction illustrated in FIG. 2, and drives the fixing motor at a predetermined speed so that a sheet conveyance speed V3 at the fixing nip portion F1 can be equal to a conveying speed V1at the transfer unit.

The pre-fixing conveyance unit 17 has been set in the first position P1 (i.e., home position). Hence, the secondary transfer exit guide 101 and the conveyance surfaces of the conveyance belts 171, 172, 173, and 174 disposed in the pre-fixing conveyance unit 17 form an approximately linear shape with respect to the sheet S moved out of the secondary transfer nip portion T2.

Even when the length of the sheet S in a conveying direction is less than a distance from the secondary transfer nip portion T2 to the fixing nip portion F1, or when the stiffness of the sheet S is equal to or more than a predetermined value, no bridging of the sheet S occurs at the pre-fixing conveyance unit 17. Thus, conveyance stability can be secured.

The bridging of the sheet means that no sheet suction to the conveyance surface of the pre-fixing conveyance unit 17 is performed, the leading edge side of the sheet is supported by the fixing entrance guide 102, and the trailing edge side of the sheet is supported by the secondary transfer exit guide 101.

When bridged, the sheet is not stuck to the pre-fixing conveyance unit 17. Hence, the sheet cannot be conveyed. According to the present exemplary embodiment, however, in the first position, the secondary transfer exit guide 101 and the conveyance surfaces of the conveyance belts 171, 172, 173, and 174 disposed in the pre-fixing conveyance unit 17 are linear in shape. Thus, even thick paper of a small size can be stably conveyed without bridging.

A suction force of a fan for suctioning a sheet may be increased in order to feed a sheet of high stiffness along the pre-fixing conveyance unit 17. In this case, the size of the fan or the necessary power needs to be increased. The present exemplary embodiment enables setting of the pre-fixing conveyance unit 17 in the first position where bridging may rarely occur. Thus, the image forming apparatus can be configured without increasing the size of the fan.

Concerning the pre-fixing conveyance unit 17, the suction fans 115 and 125 start suction in the arrow direction B in FIG. 2, and the conveyance belts 171, 172, 173, and 174 driven by the drive motor 110 start operations so that the sheet S can be conveyed in the arrow direction A in FIG. 2 at a speed V2. The conveying speed V2 of the conveyance belts 171, 172, 173, and 174 is set higher than the conveying speed V1 at the secondary transfer nip portion T2.

In step S2, based on input information about the sheet S from the user, the CPU 701 determines a conveying direction length of the sheet S. In other words, the CPU 701 determines whether the conveying direction length of the sheet S is greater than the distance from the secondary transfer unit T2 to the fixing nip portion F1.

If the CPU 701 determines that the conveying direction length of the sheet S is greater than the distance from the secondary transfer unit T2 to the fixing nip portion F1 (YES in step S2), in step S3, the CPU 701 determines whether sheet stiffness is equal to or more than a predetermined value.

If the stiffness (thickness) of the sheet S is equal to or more than the predetermined value (YES in step S3), in steps S4 and S5, the CPU 701 executes the active swinging control of the pre-fixing conveyance unit. In other words, in step S5, as illustrated in FIG. 7, the CPU 701 determines whether a leading edge SF of the sheet S has reached a detection position of the fixing entrance sensor 107 set in a predetermined position on the upstream side of the fixing nip portion F1 based on an output from the fixing entrance sensor 107.

Figure 7:
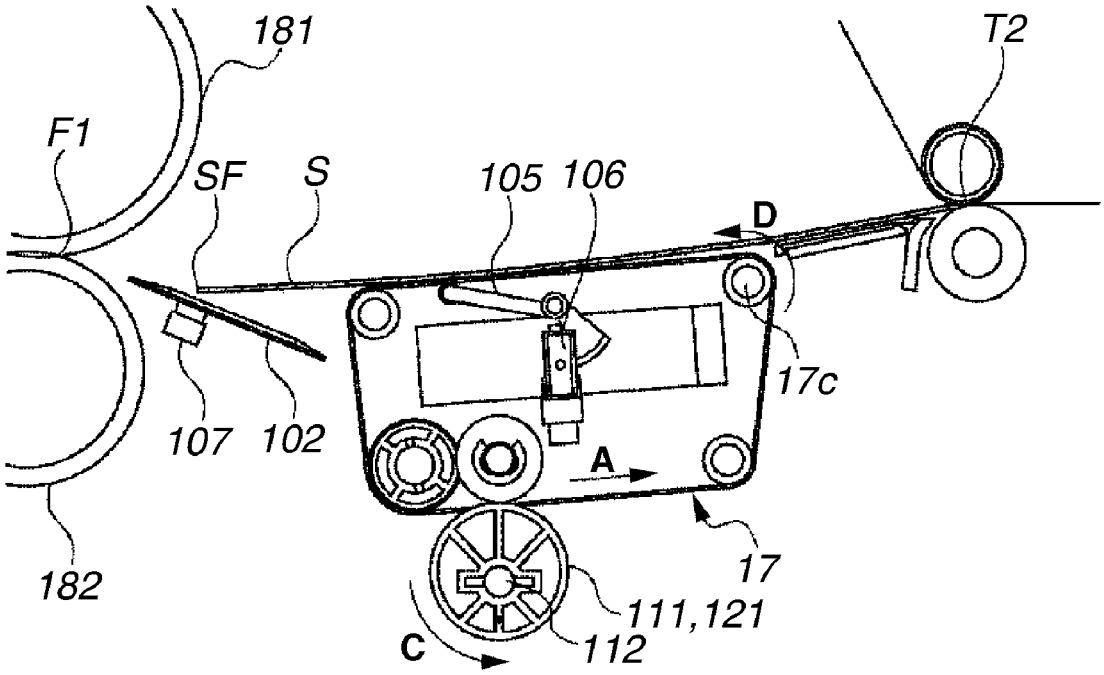
FIG. 7 is a front view of the pre-fixing conveyance unit illustrating a control state according to the first exemplary embodiment.

Then, in step S6, as illustrated in FIG. 7, if the CPU 701 determines that the leading edge SF of the sheet S has reached the detection position of the fixing entrance sensor 107 (YES in step S4), the CPU 701 starts driving of the swinging motor 104 so as to rotate the swinging cams 111 and 121 in the arrow direction C of FIG. 7.

The swinging motor 104 accordingly starts to move the pre-fixing conveyance unit 17 from the first position P1 to the second position P2. The rotation of the swinging cams 111 and 121 causes, before the leading edge SF of the sheet S reaches the fixing nip portion F1, downward changing of the sheet conveyance direction of the pre-fixing conveyance unit 17 from a state in FIG. 7 to a state in FIG. 8.

In this case, the leading edge side of the sheet is supported by the fixing entrance guide 102, and hence the leading edge side of the sheet is deformed into a curved shape. In other words, a linear shape is formed between the secondary transfer nip portion T2 and a most downstream side of the pre-fixing conveyance unit 17, and the leading edge side of the sheet is deformed into a V shape (curved shape) following along a inclination of the fixing entrance guide 102.

Figure 8:
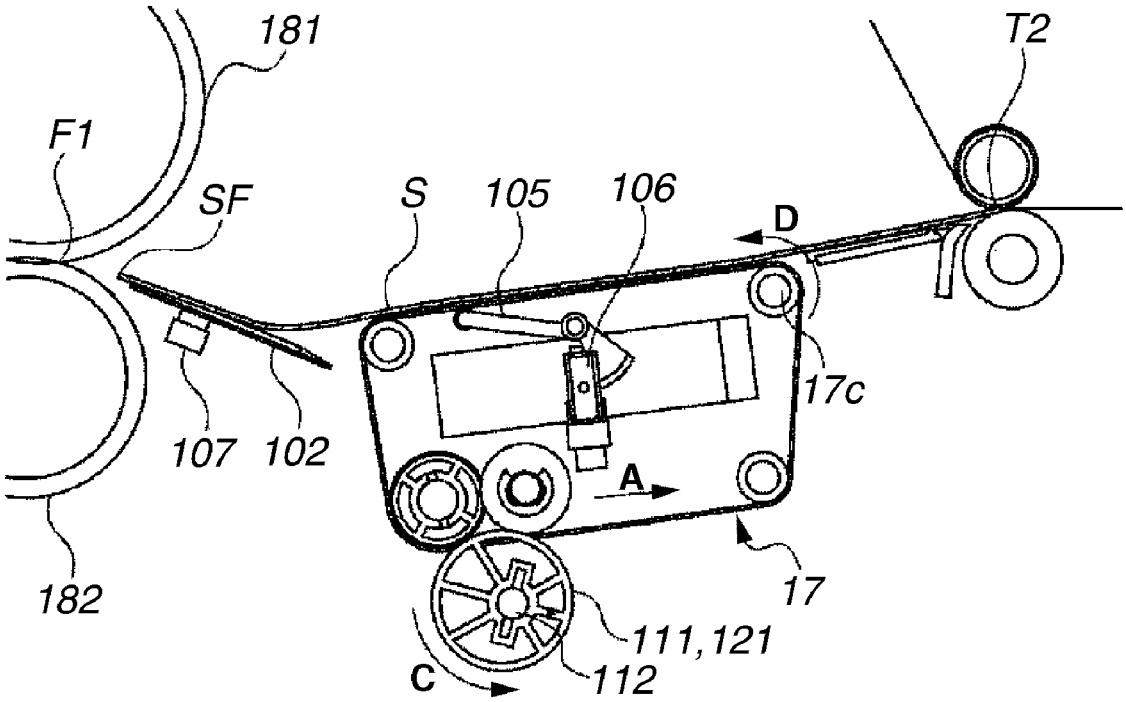
FIG. 8 is a front view of the pre-fixing conveyance unit illustrating the control state according to the first exemplary embodiment.
Figure 9:
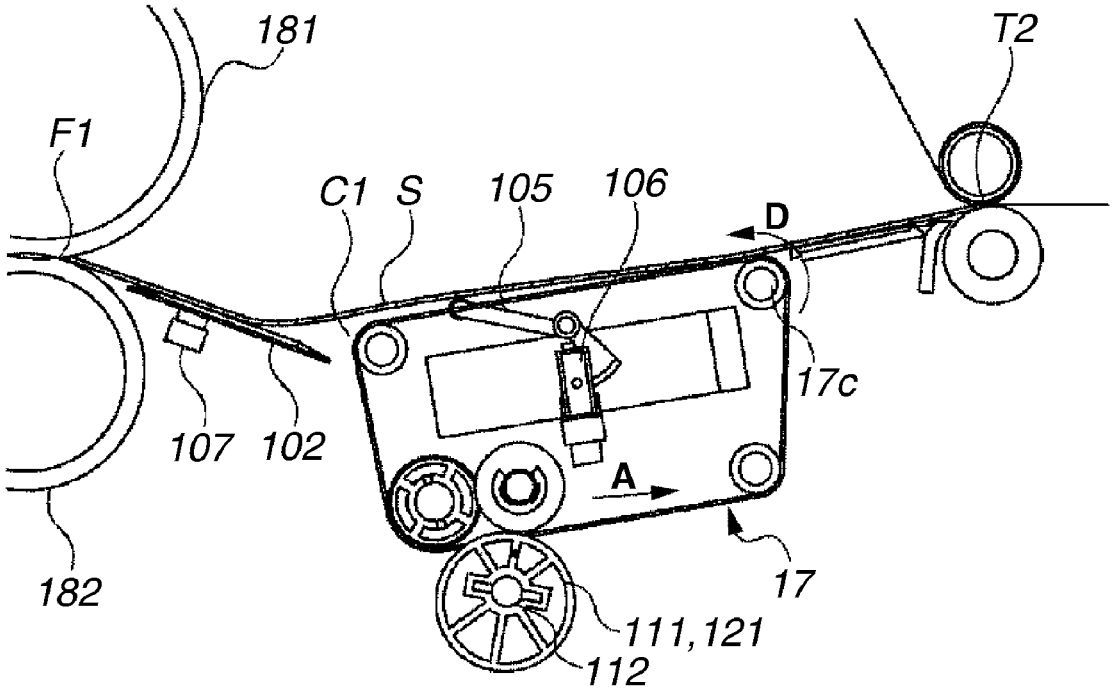
FIG. 9 is a front view of the pre-fixing conveyance unit illustrating the control state according to the first exemplary embodiment.

FIG. 9 illustrates a state where the CPU 701 further drives the swinging motor 104 so as to rotate the swinging cams 111 and 121 from a state illustrated in FIG. 8 in the arrow direction C.

While the swinging cams 111 and 121 operate to swing the conveyance belts 171, 172, 173, and 174 of the pre-fixing conveyance unit 17, the leading edge of the sheet advances to the fixing nip portion F1. The swinging of the conveyance belts 171, 172, 173 and 174 of the pre-fixing conveyance unit 17 is accompanied by deformation such as distortion of the sheet conveyed by the conveyance belts 171, 172, 173, and 174.

If the stiffness of the sheet S is equal to or more than the predetermined value, the sheet moves away from surfaces of the conveyance belts 171, 172, 173, and 174 on the downstream side of the upper surfaces of the conveyance belts 171, 172, 173 and 174 of the pre-fixing conveyance unit 17. Then, the sheet S, the fixing entrance guide 102, and the pre-fixing conveyance unit 17 form a space C1.

An example in which the timing of step S5 is determined based on the sheet detection of the fixing entrance sensor 107 has been described. However, driving of the swinging motor 104 may be started after a predetermined time has elapsed since detection of the sheet by an after-registration sensor (not illustrated) disposed between the secondary transfer nip portion T2 and the registration roller 14, to positioning of the leading edge of the sheet immediately before the fixing nip portion F1.

When swinging of the conveyance belts 171, 172, 173 and 174 causes deformation such as distortion of the leading edge side of the sheet, the leading edge of the sheet S plunges into the fixing nip portion F1.

If the sheet is distorted, the leading edge of the sheet moves more slowly as compared with the case where none of the conveyance belts 171, 172, 173, and 174 is swung. The leading edge of the sheet reaches the fixing nip portion when the conveyance belts 171, 172, 173, and 174 are swung. Thus, a speed of the leading edge of the sheet when the leading edge of the conveyed sheet reaches the fixing nip portion F1 is reduced as compared with the case where none of the conveyance belts 171, 172, 173, and 174 is swung.

In other words, performing control by the control unit so that the leading edge of the sheet can reach the fixing nip portion F1 while moving the conveyance belts 171, 172, 173 and 174 enables substantial reduction in speed when the leading edge of the sheet plunges into the fixing nip portion F1. The Shock generated at the leading edge of the sheet S when the sheet S plunges into the fixing nip portion F1 is accordingly reduced. As a result, propagation of the shock to the transfer unit via the sheet can be reduced.

The formed space C1 and the V shape of the leading edge side of the sheet S absorb the shock generated in the sheet S when the sheet S plunges into the fixing nip portion F1. The influence of the shock on the secondary transfer nip portion T2 via the sheet is accordingly reduced.

As a result, the influence of the shock generated in the sheet S when the sheet S plunges into the fixing nip portion F1 on an image to be formed on the sheet is reduced. In steps 6 and 7, after the entry of the leading edge of the sheet into the fixing nip portion F1, the CPU 701 executes fixing loop control until the trailing edge of the sheet passes through the secondary transfer nip portion T2.

The fixing loop control will be described below. The CPU 701 determines whether the trailing edge of the sheet has passed through the secondary transfer nip portion T2 based on the detection timing of the fixing entrance sensor 107, a conveying direction length of the sheet S, and a distance between the fixing entrance sensor 107 and the secondary transfer nip portion T2.

If the CPU 701 determines that the trailing edge SR of the sheet S has passed through the secondary transfer nip portion T2 (YES in step S7), in step S8, the CPU 701 drives, at a fixed speed, the fixing motor that rotates the fixing roller 181 so as to set a conveying speed V3 at the secondary transfer nip portion T2 equal to a conveying speed V1. In other words, there are no more members to generate a difference between conveying speeds for the sheet S, and hence the CPU 701 finishes the loop control.

Figure 12:
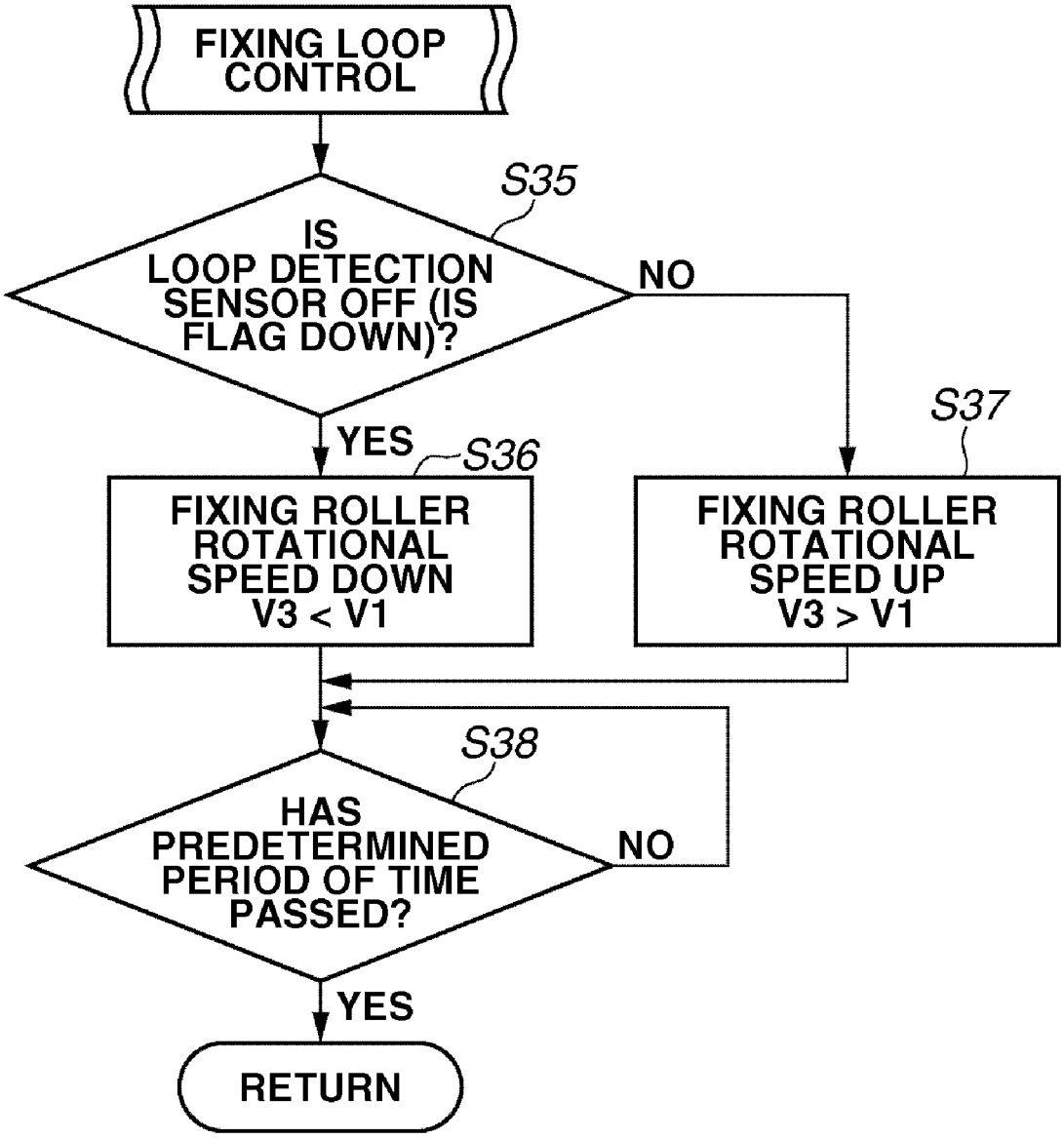
FIG. 12 is a flowchart illustrating a fixing loop control according to a second exemplary embodiment.

Then, as illustrated in FIG. 12, if the CPU 701 determines that the trailing edge SR of the sheet S has passed through the detection position of the fixing entrance sensor 107 based on the detection signal output from the fixing entrance sensor 107 (YES in step S9), in step S10, the CPU 701 determines whether to finish the job.

If the CPU 701 determines that the job is completed (YES in step S10), in step S11, the CPU 701 drives the swinging motor 104 so that the swinging cams 111 and 121 can rotate to return the pre-fixing conveyance unit 17 to the first position P1 illustrated in FIG. 2. Then, the printing operation of the image forming apparatus is completed.

If the CPU 701 determines that a conveying direction length of the sheet S is not greater than the distance from the secondary transfer nip portion T2 to the fixing nip portion F1 (NO in step S2), the CPU 701 executes neither of fixing loop control nor active swinging control of the pre-fixing conveyance unit.

In step S17, the CPU 701 drives the fixing motor at a predetermined speed so as to set a conveying speed V3 of the fixing roller 181 equal to the conveying speed V1, and then the processing proceeds to step S9. In this case, the pre-fixing conveyance unit 17 is in the first position P1, and hence no bridging or the like of the sheet S occurs in the pre-fixing conveyance unit 17. Thus, conveyance stability can be secured.

If the CPU 701 determines that stiffness of the sheet is smaller the predetermined value (No in step S3), the CPU 701 executes no active swinging control of the pre-fixing conveyance unit. In other words, in step S16, the CPU 701 drives the swinging motor 104 so as to set the pr-fixing conveyance unit 17 in the second position P2 before the sheet arrives at the pre-fixing conveyance unit 17. The pre-fixing conveyance unit 17 conveys the sheet while kept in the second position P2. Then, the processing proceeds to step S6.

A reason for non-execution of the active swinging control of the pre-fixing conveyance unit when the stiffness of the sheet is smaller the predetermined value is as follows. In the case of a sheet of low stiffness, speed unevenness at the secondary transfer nip portion T2 caused by plunging of the leading edge of the sheet S into the fixing nip portion F1 rarely occurs, and image disturbance or the like rarely occurs. In order to prevent paper wrinkles likely to occur uniquely to the sheet of low stiffness during holding and conveying at the fixing nip portion F1, the sheet S is fed along the fixing entrance guide 102 from the slightly upstream side of the fixing nip portion F1.

If the CPU 701 determines that the job is not completed (NO in step S10), in step S12, the CPU 701 determines whether the conveying direction length of the sheet S is greater than the distance from the secondary transfer nip portion T2 to the fixing nip portion F1.

If the CPU 701 determines that the conveying direction length of the sheet S is not greater than the distance from the secondary transfer nip portion T2 to the fixing nip F1 (NO in step S12), in step S15, the CPU 701 drives the swinging motor so as to set the pre-fixing conveyance unit 17 in the first position P1. Then, the processing proceeds to step S9.

If the CPU 701 determines that the conveying direction length of the sheet S is greater than the distance from the secondary transfer nip portion T2 to the fixing nip portion F1 (YES in step S12), in step S13, the CPU 701 determines whether stiffness of a next sheet S is equal or more than the predetermined value.

If the CPU 701 determines that the stiffness of the sheet S is smaller the predetermined value (NO in step S13), the processing proceeds to step S16. If the CPU 701 determines that the stiffness of the sheet S is equal to or more than the predetermined value (YES in step S13), in step S14, the CPU 701 drives the swinging motor so as to set the pre-fixing conveyance unit 17 in the first position P1, and the processing proceeds to step S4.

Figure 6:
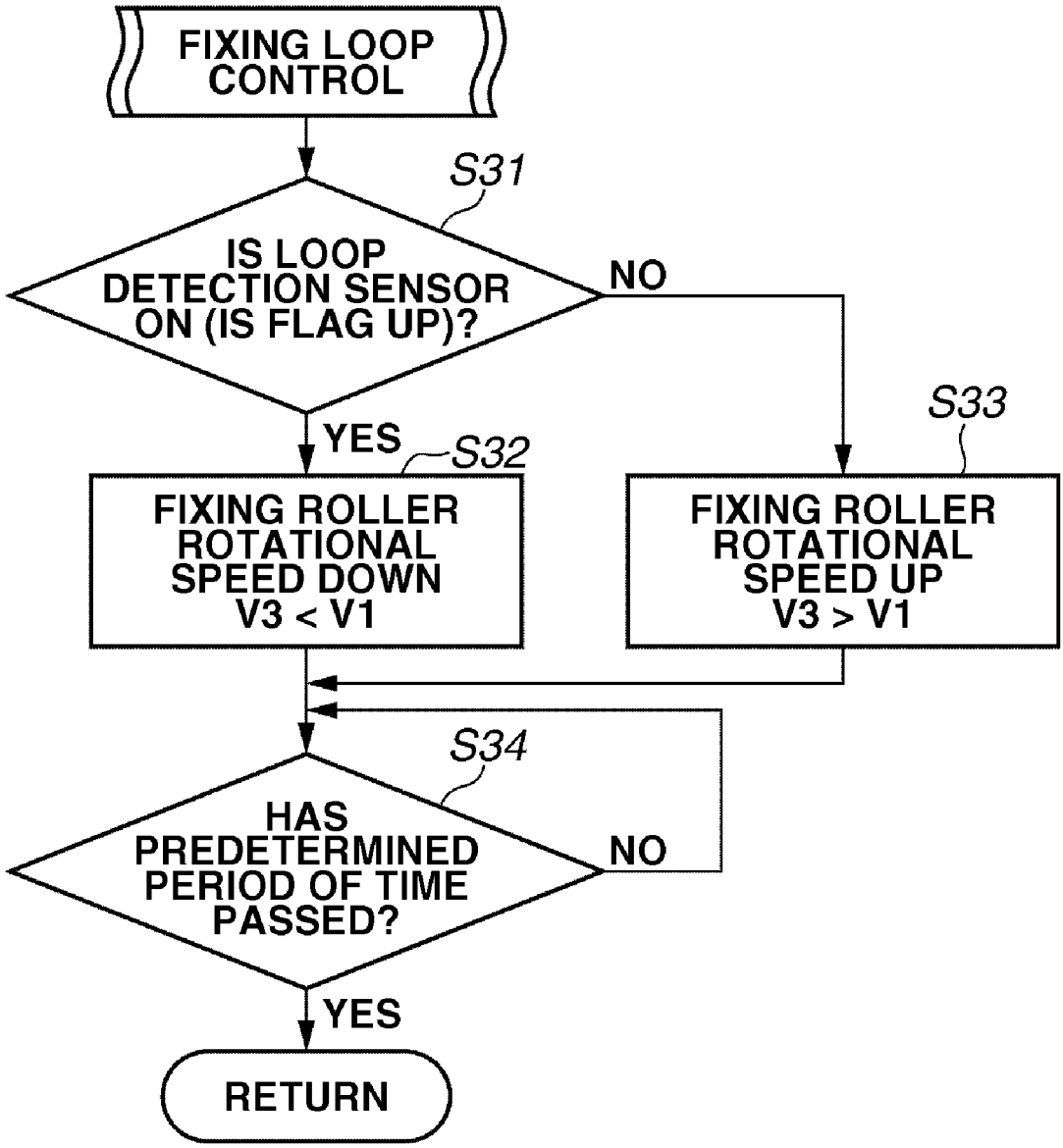
FIG. 6 is a flowchart illustrating the fixing loop control according to the first exemplary embodiment.

FIG. 6 illustrates the fixing loop control performed in step S6. More specifically, in step S31, the CPU 701 determines that the loop detection sensor 106 has output an ON signal as a result of shielding the loop detection sensor 106 by a sensor shielding portion 1051 of the loop detection flag 105.

In a state where the loop detection flag 105 shields the loop detection sensor 106 (sensor ON), a loop of the sheet nipped by the secondary transfer nip portion T2 and the fixing nip portion F1 is small, and hence the loop detection flag 105 is up.

If the CPU 701 determines that the loop detection sensor 106 is ON (YES In step S31), in step S32, the CPU 701 controls the fixing motor so as to set a conveying speed V3 at the fixing nip portion F1 lower than the sheet conveyance speed V1 at the secondary transfer nip portion T2.

On the other hand, if the sensor shielding portion 1051 does not shield the loop detection sensor 106 (sensor OFF) (NO in step S31), the processing proceeds to step S33. In step S33, the CPU 701 controls the fixing motor so that the sheet conveyance speed V3 at the fixing unit F1 becomes higher than the sheet conveyance speed V1 at the secondary transfer nip portion T2. The sensor is ON when no sheet S is present on the loop detection sensor 106.

Figure 10:
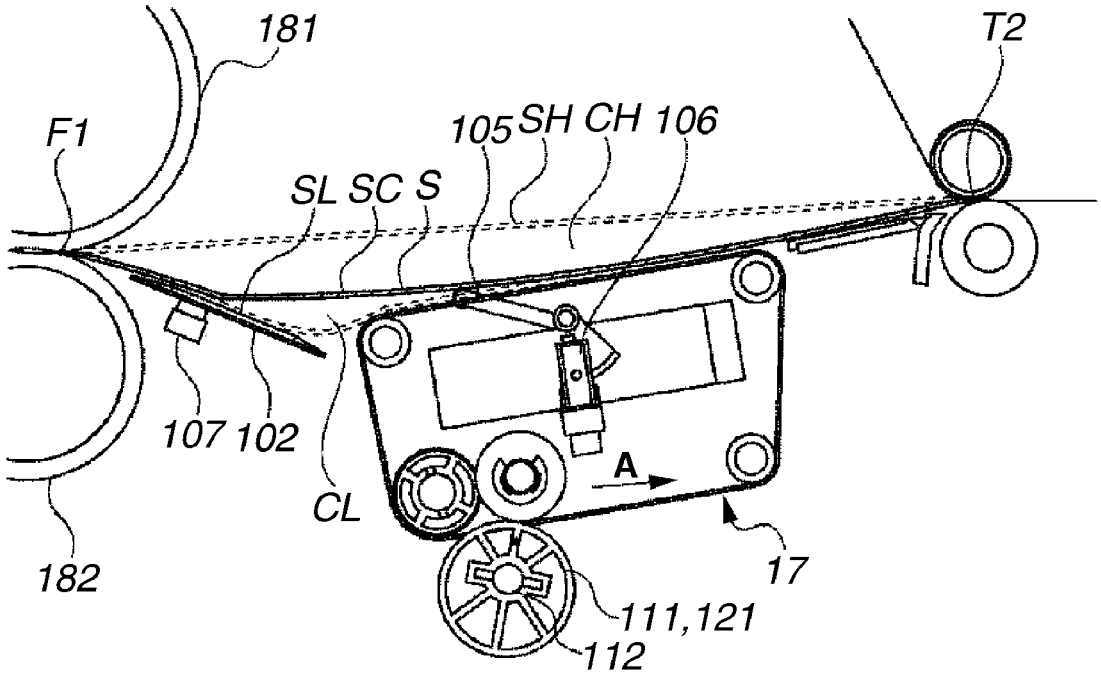
FIG. 10 is a front view of the pre-fixing conveyance unit illustrating the control state thereof according to the first exemplary embodiment.
Figure 11:
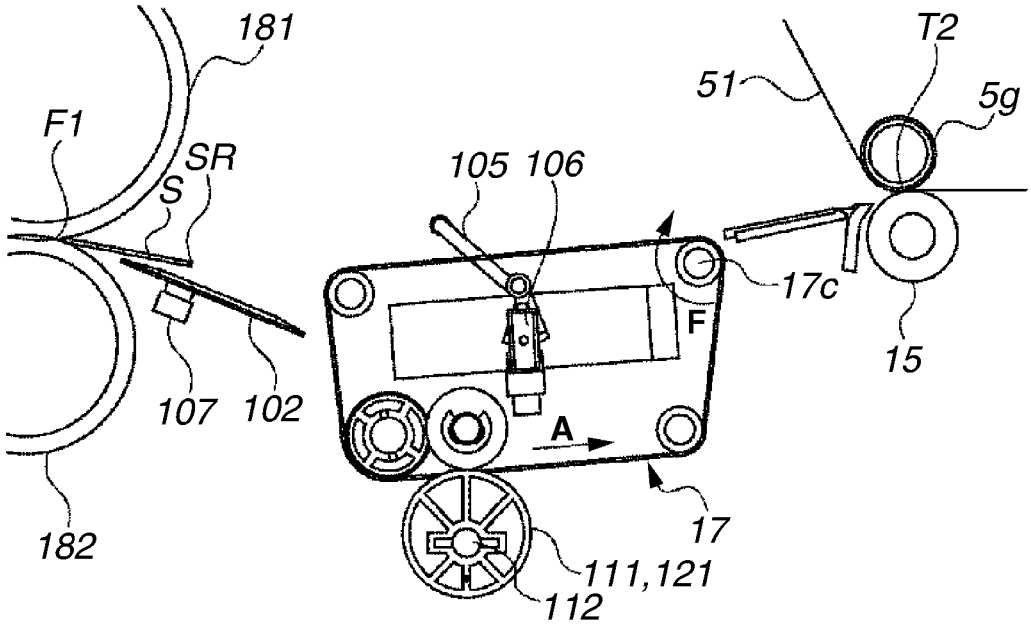
FIG. 11 is a front view of the pre-fixing conveyance unit illustrating the control state thereof according to the first exemplary embodiment.

Performing the fixing loop control this way prevents, as illustrated in FIG. 10, the sheet S from removing a transferred surface side loop forming space CH and a backside loop forming space CL while the sheet S is simultaneously held by the secondary transfer nip portion T2 and the fixing nip portion F1.

After the speed setting of the fixing motor in step S32 and step S33, in step S34, the CPU 701 waits for a passage of predetermined time and then the processing proceeds to step S7 of FIG. 5.

Referring to FIG. 10, a boundary position where an output state from the loop detection sensor 106 is switched between an ON state and an OFF state will be described.

A position of the loop detection flag 105, in which an output from the loop detection sensor 106 is switched, is set, in consideration of a response time until the fixing motor reaches a target speed, in a center between a pulling limit profile SH of the sheet S and a pushing-in limit profile SL of the sheet S. A sheet shape, by which switching between the ON and OFF states of the loop detection sensor 106 is performed, is illustrated as a sheet profile SC in FIG. 10.

In other words, around the sheet profile SC, when the shape of the sheet S is on the pulling limit sheet profile SH, a conveying speed V3 at the fixing nip portion F1 becomes lower than the conveying speed V1 at the secondary transfer nip portion.

When the shape of the sheet S is on the pushing-in profile SL side from the sheet profile SC, the CPU 701 controls a rotational speed of the fixing motor so that the conveying speed V3 at the fixing nip portion F1 becomes higher than the conveying speed V1 at the secondary transfer nip portion.

The first exemplary embodiment provides the following effects. The sheet profile is efficiently changed by performing the active swinging control of the pre-fixing conveyance unit for each sheet to be conveyed. Even when a shock generated at the plunging time of the leading edge of the sheet S into the fixing nip portion F1 is applied to the sheet S, the shock can be absorbed by the slackened portion of the sheet formed by the change of the sheet profile.

In the swinging state of the conveyance belts 171, 172, 173, and 174, the leading edge of the sheet S plunges into the fixing nip portion F1. In the swinging state of the conveyance belts 171, 172, 173, and 174, in the present exemplary embodiment, the leading edge side of the sheet is continuously deformed into a V shape.

In the state where the conveyance belts 171, 172, 173 and 174 are swung and the leading edge side of the sheet is continuously deformed into a V shape, a position of the leading edge of the conveyed sheet is retreated more on the upstream side in conveying direction as compared with a case where the conveyance belts 171, 172, 173 and 174 are not swung (sheet is not deformed).

Thus, when the sheet is distorted into a V shape, a speed of the leading edge of the sheet is lower than that as compared with the case where the conveyance belts 171, 172, 173, and 174 are not swung. As a result, when the conveyance belts 171, 172, 173, and 174 are swung to distort the leading edge side of the sheet, plunging the leading edge of the sheet S into the fixing nip portion F1 enables a substantial reduction in speed of the leading edge of the sheet when the leading edge of the sheet plunges into the fixing nip portion F1.

The shock generated in the sheet S when the sheet S plunges into the fixing nip portion F1 are reduced, and hence propagation of the shock to the transfer unit via the sheet is reduced. In the present exemplary embodiment, the leading edge side of the sheet is deformed into the V shape. Thus, the V-shaped portion of the sheet absorbs the shock generated in the sheet S when the sheet S plunges into the fixing nip portion F1.

The propagation of the shock generated in the sheet S when the sheet S plunges into the fixing nip portion F1 to the transfer unit via the sheet is reduced. As a result, an image forming apparatus capable of preventing image disturbance or the like and securing conveyance stability can be provided.

For performing the active swinging control of the pre-fixing conveyance unit, the movement of the pre-fixing conveyance unit 17 to the second position P2 is started based on the output from the fixing entrance sensor 107 that detects the leading edge of the sheet.

With respect to the timing of the entry of the leading edge of the sheet into the fixing nip portion F1, the sheet conveyance direction of the pre-fixing conveyance unit 17 can be changed in an appropriate timing, enabling efficient changing of the sheet profile.

Performing the fixing loop control results in continuous formation of a certain loop in the sheet S between the secondary transfer nip portion T2 and the fixing nip portion F1. Thus, pulling of the sheet S or an excessive loop can be prevented between the secondary transfer nip portion T2 and the fixing nip portion F1, and thus image disturbance or the like can be reduced.

The movement of the pre-fixing conveyance unit 17 from the first position P1 to the second position P2, and the supporting of the leading edge side of the sheet by the fixing entrance guide 102 enables separation of the sheet from the downstream side portion of the conveyance surface of the pre-fixing conveyance unit 17 to form a space C1 (refer to FIG. 10).

Thus, the sheet distortion generated when the sheet plunges into the fixing nip portion F1 can be removed, and transmission of the shock generated by the plunging of the leading edge of the sheet into the fixing nip portion F1 can be reduced. As a result, an image forming apparatus capable of preventing image disturbance or the like can be provided.

The formed space C1 increases a sheet loop formable area during the fixing loop control, permitting slow response time to a rotational speed change of the fixing roller 181 during the fixing loop control. Thus, specification requirements of the fixing motor for rotating the fixing motor 18 can be less strict, realizing lower costs.

Moving conditions of the pre-fixing conveyance unit 17 are changed according to physical properties or a type of a sheet to be conveyed. In other words, the active swinging control of the pre-fixing conveyance unit is performed in the case of conveying a sheet with predetermined stiffness (thickness) or more. In the case of conveying a sheet with stiffness lower than the predetermined stiffness (thickness), the pre-fixing conveyance unit 17 conveys the sheet while being kept in the second position P2.

When a conveying direction length of the sheet is less than the distance between the secondary transfer nip portion T2 and the fixing nip portion F1, the pre-fixing conveyance unit 17 conveys the sheet while being kept in the first position P1.

Thus, when stiffness of the sheet is low, and image disturbance or the like caused by the shock generated when the leading edge side of the sheet plunges into the fixing nip portion F1, or when the length of the sheet is small, no active swinging control of the pre-fixing conveyance unit is performed. As a result, power consumption of the image forming apparatus can be reduced.

In the first exemplary embodiment, as the active swinging control of the pre-fixing conveyance unit, immediately before the leading edge of the sheet S reaches the fixing nip portion F1, the pre-fixing conveyance unit 17 moves the downstream side portion of the pre-fixing conveyance unit 17 downward during the sheet conveyance by the pre-fixing conveyance unit 17. However, as the active swinging control of the pre-fixing conveyance unit, immediately before the leading edge of the sheet S plunges into the fixing nip portion F1, the pre-fixing conveyance unit 17 may be rotated to move the downstream side portion of the pre-fixing conveyance unit 17 upward during the sheet conveyance of the pre-fixing conveyance unit 17.

Hereinafter, referring to FIGS. 12 to 14, a second exemplary embodiment will be described. Differences in configuration from the first exemplary embodiment will be described in detail, while detailed description of components similar to those of the first exemplary embodiment is omitted.

Figure 13:
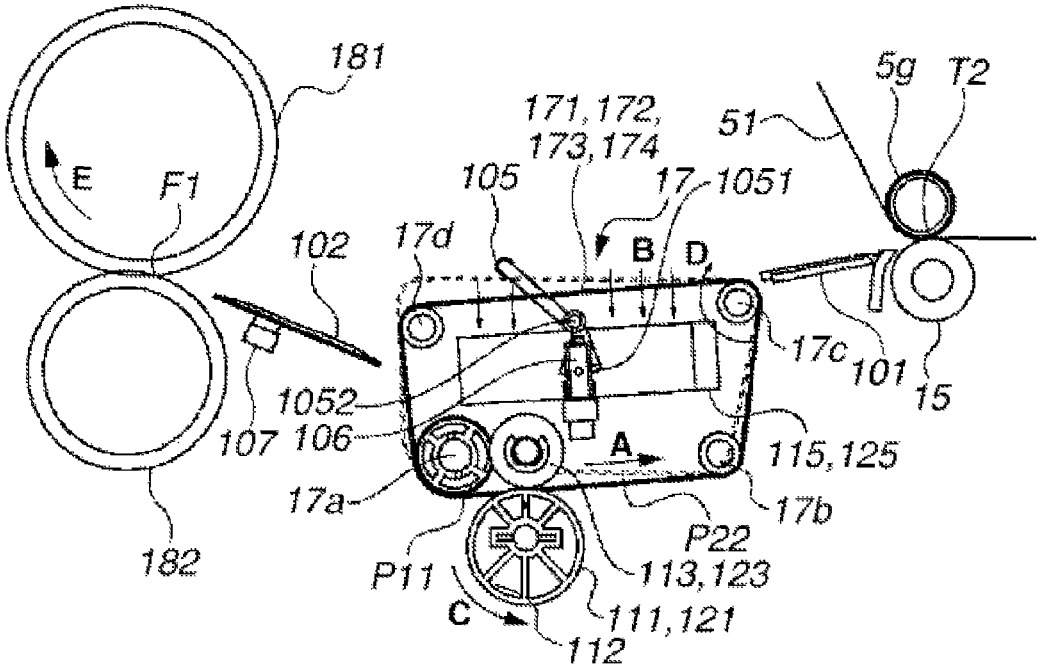
FIG. 13 is a front view of a pre-fixing conveyance unit illustrating a control state thereof according to the second exemplary embodiment.

In the second exemplary embodiment, as illustrated in FIG. 13, a position where swinging members 113 and 123 come into contact with bottom dead centers of swinging cams 111 and 121 is defined as a first position P11 of a pre-fixing conveyance unit 17. Rotation of the swinging cams 111 and 121 in an arrow direction C in FIG. 13 is accompanied by rotation of the pre-fixing conveyance unit 17 around a swinging shaft 17*c* in an arrow direction D in FIG. 13. A position of the pre-fixing conveyance unit 17 where the top dead centers of the swinging cams 111 and 121 come into contact with the swinging members 113 and 123 is defined as a second position P22.

Immediately before a leading edge of a sheet plunges into a fixing nip portion F1, rotation of the pre-fixing conveyance unit 17 from the first position P11 to the second position P22 is started. Changing a conveying direction of the pre-fixing conveyance unit 17 during sheet conveyance of the pre-fixing conveyance unit 17 forms a reverse V shape (curved shape) on a leading edge side of a sheet S.

During the movement of the pre-fixing conveyance unit 17 from the first position P11 to the second position P22, the leading edge of the sheet reaches the fixing nip portion F1. In the present exemplary embodiment, distortion and shock generated in the sheet S when the sheet S plunges into the fixing nip portion F1 can be absorbed, reducing an influence given on an image from a secondary transfer unit to an upstream side during an image formation process.

In the present exemplary embodiment, the logic of the fixing loop control (FIG. 6) in the first exemplary embodiment is reversed as illustrated in FIG. 12.

Referring to FIG. 12, in step S35, a CPU 701 determines whether a sensor shielding portion 1051 of a loop detection flag 105 shields a loop detection sensor 106 (sensor ON).

If the CPU 701 determines, based on a pushed-down state of the loop detection flag 105, that an output from the loop detection sensor 106 is an OFF signal (YES in step S35), the processing proceeds to step S36. In step S36, the CPU 701 controls a fixing motor so that a conveying speed V3 at the fixing nip portion F1 can be lower than a sheet conveyance speed V1 at a secondary transfer nip portion T2.

If the CPU 701 determines that the sensor shielding portion 1051 shields the loop detection sensor 106 and an output signal from the loop detection sensor 106 is not OFF (No in step S35), the processing proceeds to step S37. In step S37, the CPU 701 controls the fixing motor so that the sheet conveyance speed V3 at the fixing nip portion F1 becomes higher than the sheet conveyance speed V1 at the secondary transfer nip portion T2. In step S38, the CPU 701 waits for a passage of predetermined time and then finishes the loop control.

Figure 14:
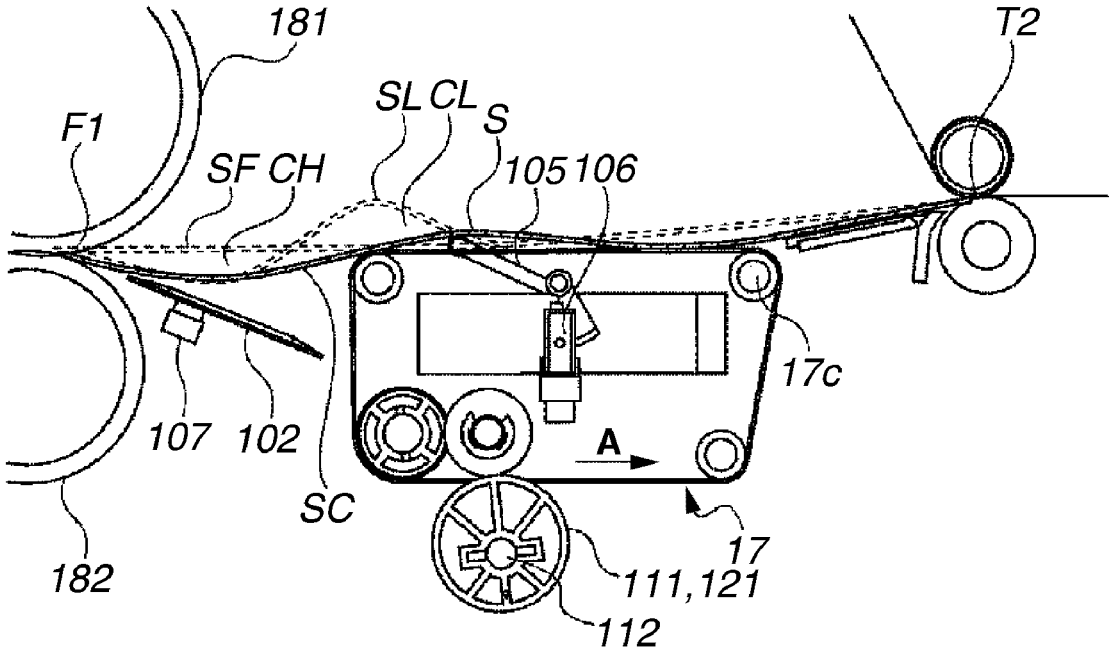
FIG. 14 is a front view of the pre-fixing conveyance unit illustrating the control state thereof according to the second exemplary embodiment.

Referring to FIG. 14, a state after the leading edge of the sheet S has plunged into the fixing nip portion F1 will be described below.

While the sheet S is simultaneously held by the secondary transfer nip portion T2 and the fixing nip portion F1, as illustrated in FIG. 14, the sheet S is prevented from losing a transferred surface side loop forming space CL and a backside loop forming space CH.

A position of the loop detection flag 105, in which an output from the loop detection sensor 106 is switched, is set, in consideration of a response time until the fixing motor reaches a target speed, in a center between a pulling limit profile SH of the sheet S and a pushing-in limit profile SL of the sheet S. A sheet shape, by which switching between the ON and OFF states of the loop detection sensor 106 is performed, is illustrated as a sheet profile SC in FIG. 11.

When the shape of the sheet S is on the pulling limit profile SH side around the sheet profile SC, the CPU 701 sets the conveying speed V3 at the fixing nip portion F1 lower than the conveying speed V1 at the secondary transfer nip portion. When the shape of the sheet S is on the pushing-in limit profile SL side from the sheet profile SC, the CPU 701 controls a rotational speed of the fixing motor so that the conveying speed V3 at the fixing nip portion F1 becomes higher than the conveying speed V1 at the secondary transfer nip portion.

The second exemplary embodiment provides effects similar to those of the first exemplary embodiment. The first and second exemplary embodiments illustrate the example where the sheet is suctioned to the suction conveyance belts to be conveyed. However, the sheet may be conveyed by belts rotated without suctioning the sheet.

In this case, while the belts are moved to distort the sheet, the leading edge of the sheet conveyed by the belts reaches the fixing nip portion F1, thereby providing similar effects.

Figure 15A:
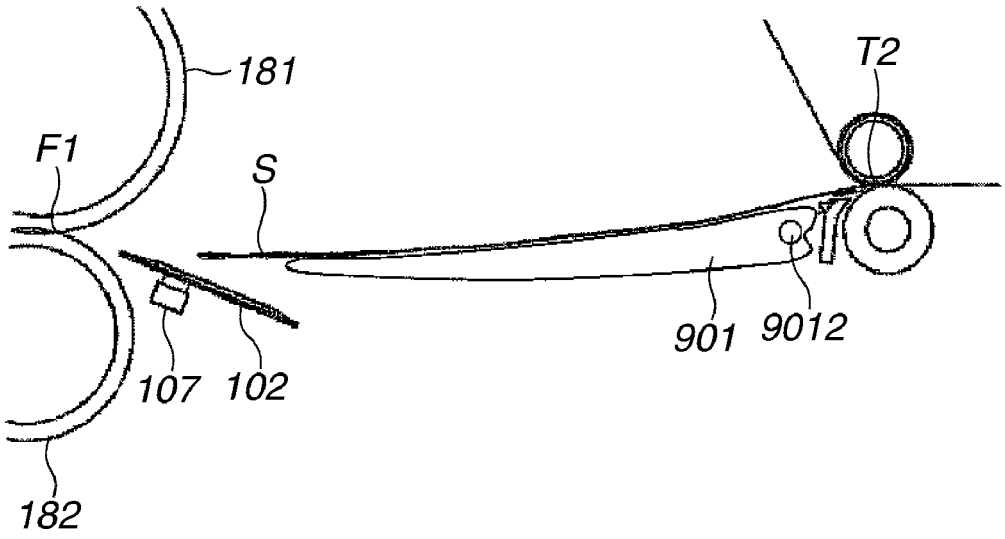
FIG. 15A illustrates a modified example according to the exemplary embodiment of the present invention.
Figure 15B:
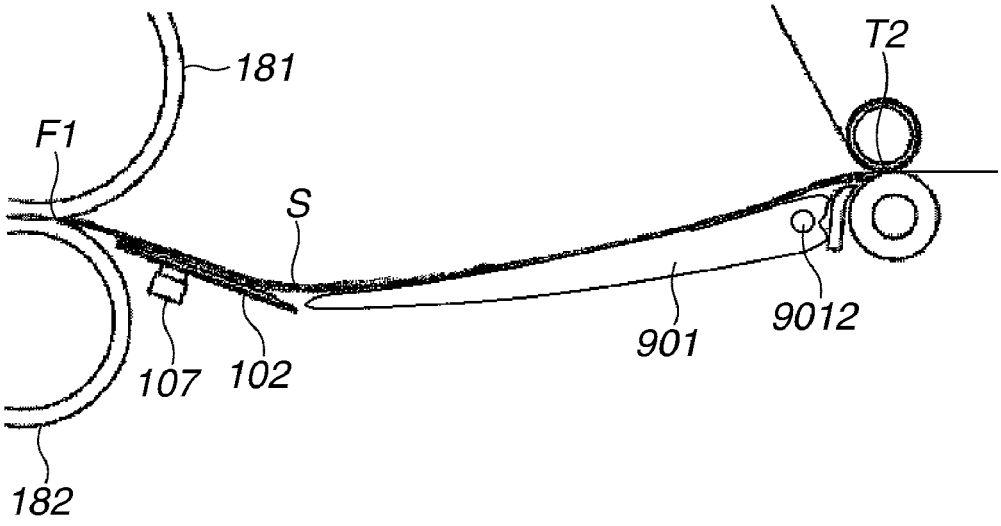
FIG. 15B illustrates the modified example according to the exemplary embodiment of the present invention.

Between the secondary transfer nip portion T2 and the fixing nip portion F1, a movable guide may be provided as a conveyance unit. FIGS. 15A and 15B illustrate the modified example. The movable guide 901 disposed as the conveyance unit between the secondary transfer nip portion T2 and the fixing nip portion F1 is supported to be capable of swinging around a rotary shaft 9012. The movable guide 901 accordingly moves in a thickness direction of the sheet to be conveyed.

The movable guide 901 comes into contact with the sheet fed to the fixing nip portion F1 to guide the sheet. When a fixing entrance sensor 107 detects a leading edge of the sheet, the movable guide starts swinging from a position illustrated in FIG. 15A to a position illustrated in FIG. 15B. During the swinging of the movable guide 901, the leading edge of the sheet reaches the fixing nip portion F1.

While the movable guide 901 operates, the conveyed sheet is distorted. Thus, as in the case of the first and second exemplary embodiments, a speed of the leading edge of the sheet is lowered when the leading edge of the sheet reaches the fixing nip portion F1. As a result, the shock generated when the leading edge of the sheet plunges into the fixing nip portion F1 is reduced.

Thus, transmission of the shock generated when the leading edge of the sheet plunges into the fixing nip portion F1 to the secondary transfer nip portion T2 via the sheet is reduced. The swinging of the movable guide 901 is, as in the case of the mechanism for moving the pre-fixing conveyance unit 17 in the first exemplary embodiment, performed by a cam driven by a motor.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-020239 filed Jan. 30, 2009, which is hereby incorporated by reference herein in its entirety.

What is claimed is:

1. An image forming apparatus comprising:

a transfer unit configured to transfer a toner image to a sheet;

a fixing unit configured to fix the toner image transferred to the sheet on the sheet;

a conveyance unit disposed between the transfer unit and the fixing unit to convey the sheet;

a moving unit configured to move the conveyance unit so that a speed of a leading edge of the sheet conveyed by the conveyance unit from the transfer unit to the fixing unit is reduced; and a control unit configured to control so that the leading edge of the sheet reaches the fixing unit while moving the conveyance unit by the moving unit.

2. The image forming apparatus according to claim 1, wherein the conveyance unit conveys the sheet in a state that the conveyance unit suctions the sheet to a conveyance surface of the conveyance unit, and wherein the control unit controls so that the leading edge of the sheet reaches the fixing unit while moving the conveyance surface of the conveyance unit in a thickness direction of the sheet by the moving unit.

3. The image forming apparatus according to claim 2, further comprising a fixed guiding member disposed between the conveyance unit and the fixing unit to guide the sheet, wherein a leading edge side of the sheet guided by the guiding member is deformed by moving a downstream side of the conveyance surface of the conveyance unit in a sheet conveyance direction downward by the moving unit.

4. The image forming apparatus according to claim 2, further comprising a guiding member disposed between the conveyance unit and the fixing unit to guide the sheet, wherein the moving unit moves the conveyance unit so that a portion of a downstream side of the conveyance surface of the conveyance unit in a sheet conveyance direction is separated from the sheet conveyed by the conveyance unit by guiding a leading edge side of the sheet by the guiding member.

5. The image forming apparatus according to claim 2, wherein the control unit controls the moving unit to move, in response to a thickness of the conveyed sheet being equal to or more than a predetermined thickness, the conveyance surface of the conveyance unit while the conveyance unit conveys the sheet, and wherein the control unit controls, in response to the thickness of the conveyed sheet being less than the predetermined thickness, not to move the conveyance surface of the conveyance unit while the conveyance unit conveys the sheet.

6. The image forming apparatus according to claim 2, wherein the moving unit swings the conveyance unit between a first position where a sheet conveyance direction by the conveyance unit becomes a first direction and a second position where a sheet conveyance direction of the conveyance unit becomes a second direction downward more than the first direction, and wherein the control unit performs control in so that, before the leading edge of the sheet conveyed by the conveyance unit set in the first position reaches the fixing unit, the moving unit starts swinging of the conveyance unit from the first position to the second position, and the leading edge of the sheet conveyed by the conveyance unit reaches the fixing unit during the swinging of the conveyance unit from the first position to the second position.

7. The image forming apparatus according to claim 2, wherein the moving unit swings the conveyance unit between a first position where a sheet conveyance direction of the conveyance unit becomes a first direction and a second position where a sheet conveyance direction of the conveyance unit becomes a second direction upward more than the first direction, and wherein the control unit performs control so that, before the leading edge of the sheet conveyed by the conveyance unit set in the first position reaches the fixing unit, the moving unit starts swinging of the conveyance unit from the first position to the second position, and the leading edge of the sheet conveyed by the conveyance unit reaches the fixing unit during the swinging of the conveyance unit from the first position to the second position.

8. The image forming apparatus according to claim 1, wherein the moving unit moves a downstream side of the conveyance unit in a sheet conveyance direction down or up.

9. The image forming apparatus according to claim 1, further comprising a sheet detection unit configured to output a signal in response to detection of the leading edge of the sheet, wherein, in response to the leading edge of the conveyed sheet being determined to have reached a predetermined position on an upstream side of the fixing unit according to the signal output from the sheet detection unit, the control unit controls the moving unit to start movement of the conveyance unit.

10. The image forming apparatus according to claim 1, further comprising a loop detection unit configured to output a signal according to a loop amount of the sheet between the transfer unit and the fixing unit in a state where the sheet is sandwiched by the transfer unit and the fixing unit, wherein a sheet conveyance speed by the fixing unit is changed according to the signal output from the loop detection unit.

11. The image forming apparatus according to claim 10, wherein a relationship of $V1<V2$ is satisfied, where V1 is a sheet conveyance speed V1 at the transfer unit and V2 is a sheet conveyance speed V2 by the conveyance unit, and wherein the control unit switches, based on the signal output from the loop detection unit, setting of a sheet conveyance speed V3 at the fixing unit between a speed higher than the sheet conveyance speed V1 and a speed lower than the sheet conveyance speed V1.

12. The image forming apparatus according to claim 1, wherein the moving unit moves the conveyance unit so that distortion in the sheet conveyed from the transfer unit to the fixing unit is generated, and wherein the control unit controls so that the leading edge of the sheet reaches the fixing unit while moving the conveyance unit to generate distortion in the conveyed sheet.

13. The image forming apparatus according to claim 1, wherein the conveying unit has a conveying belt onto which a sheet is suctioned by a suctioning portion and which conveys the sheet by rotating, the moving unit swings the conveying belt around a swinging center provided on an upstream side of the conveying belt in a sheet conveyance direction, and the control unit controls so that the leading edge of the sheet reaches the fixing unit while swinging the conveying belt around the swinging center by the moving unit.

14. An image forming apparatus comprising:

a transfer unit configured to transfer a toner image to a sheet;

a fixing unit configured to fix the toner image transferred to the sheet on the sheet;

a conveying belt onto which a sheet is suctioned by a suctioning portion and which conveys the sheet from the transfer unit to the fixing unit by rotating;

a moving unit configured to swing the conveying belt around a swinging center provided on an upstream side of the conveying belt in a sheet conveyance direction; and a control unit configured to control so that a leading edge of the sheet conveyed by the conveying belt reaches the fixing unit while swinging the conveying belt around the swinging center by the moving unit.

15. The image forming apparatus according to claim 14, further comprising a fixed guiding member disposed between the conveying belt and the fixing unit to guide the sheet, wherein a leading edge side of the sheet guided by the guiding member is deformed by moving a downstream side of the conveyance surface of the conveying belt in a sheet conveyance direction downward by the moving unit.

16. The image forming apparatus according to claim 14, further comprising a guiding member disposed between the conveying belt and the fixing unit to guide the sheet, wherein the moving unit moves the conveying belt so that a portion of a downstream side of the conveyance surface of the conveying belt in a sheet conveyance direction is separated from the sheet conveyed by the conveying belt by guiding a leading edge side of the sheet by the guiding member.

17. The image forming apparatus according to claim 14, wherein the control unit controls the moving unit to move, in response to a thickness of the conveyed sheet being equal to or more than a predetermined thickness, the conveyance surface of the conveying belt while the conveying belt conveys the sheet, and wherein the control unit controls, in response to the thickness of the conveyed sheet being less than the predetermined thickness, not to move the conveyance surface of the conveying belt while the conveying belt conveys the sheet.

* * * * *